United States Patent [19]

Mörz et al.

[11] Patent Number: 4,794,352

[45] Date of Patent: Dec. 27, 1988

[54] HIGH POWER JUNCTION CIRCULATOR FOR HIGH FREQUENCIES

[75] Inventors: Günter Mörz, Ludwigsburg; Wolfgang Weiser, Aspach, both of Fed. Rep. of Germany

[73] Assignee: ANT Nachrichtentechnik GmbH, Backnang, Fed. Rep. of Germany

[21] Appl. No.: 103,728

[22] Filed: Oct. 2, 1987

[30] Foreign Application Priority Data

Oct. 4, 1986 [DE] Fed. Rep. of Germany ..... 3633910

[51] Int. Cl.[4] ..... H01P 1/387; H01P 1/39

[52] U.S. Cl. ..... 333/1.1; 333/24.1

[58] Field of Search ..... 333/1.1, 24.1, 24.2

[56] References Cited

U.S. PATENT DOCUMENTS

| | | | |
|---|---|---|---|
| 3,089,101 | 5/1963 | Chait et al. | 333/1.1 |
| 3,246,262 | 4/1966 | Wichert . | |
| 3,341,789 | 9/1967 | Goodman et al. | 333/1.1 |
| 3,466,571 | 9/1969 | Jansen et al. . | |
| 3,500,256 | 3/1970 | Carter et al. . | |
| 3,662,291 | 5/1972 | Cotter . | |
| 3,714,608 | 1/1973 | Barnes et al. | 333/1.1 |
| 3,749,962 | 7/1973 | Smith et al. . | |
| 4,280,111 | 7/1981 | Forterre et al. | 333/1.1 |
| 4,605,915 | 8/1986 | Marshall et al. . | |

FOREIGN PATENT DOCUMENTS 781024 8/1957 United Kingdom .

OTHER PUBLICATIONS

F. Okada et al., "Design of a High-Power CW Y-Junction Waveguide Circulator," IEEE Transactions on Microwave Theory and Techniques, vol. MTT-26, No. 5 (May, 1978) pp. 364-369.

F. Okada et al., "High-Power Circulators for Industrial Processing Systems," IEEE Transactions on Magnetics, vol. MAG-17, No. 6 (Nov., 1981) pp. 2957-2960.

Wilhelm H. Von Aulock, "Selection of Ferrite Materials for Microwave Device Applications", I.E.E.E. Transactions on Magnetics, MAG-2, No. 3 (Sep. 1966) pp. 251-255.

*Primary Examiner*—Paul Gensler

*Attorney, Agent, or Firm*—Spencer & Frank

[57] ABSTRACT

In a high power, high-frequency junction circulator which includes a cooled ferrite structure disposed in a microwave junction zone where it is subjected to a static magnetic field, the ferrite structure is composed of a plurality of stacked ferrite balls. A coolant flows around the balls to carry away heat.

11 Claims, 2 Drawing Sheets

HIGH POWER JUNCTION CIRCULATOR FOR HIGH FREQUENCIES

CROSS REFERENCE TO RELATED APPLICATIONS

The subject matter of this application is related to that of a copending application entitled "High Power Junction Circulator for High Frequencies" by the joint inventors of the present application and others, the copending application having been filed concurrently herewith and having been assigned Ser. No. 07/103,751. The subject matter of this application is also related to that of copending application entitled "Microwave Junction Circulator" by the joint inventors of the present application and others, the copending application having been filed concurrently herewith and having been assigned Ser. No. 07/103,727. both copending applications are assigned to the assignee of the present application.

BACKGROUND OF THE INVENTION

The present invention relates to a junction circulator for high power, high-frequency use, and more particularly to a junction circulator of the type which includes a cooled ferrite structure disposed in a microwave junction zone where it is exposed to a static magnetic field.

A microwave circulator is a coupling device having a number of ports for connection to microwave transmission lines, such as waveguides or striplines. Microwave energy entering one port of the circulator is transferred to the next adjacent port in a predetermined direction. A threeport microwave circulator, for example, may be used to transfer energy from a klystron connected to the first port to a particle accelerator connected to the second port. Any microwave energy reflected back to the circulator by the particle accelerator then exits via the third port, so that the reflected energy is diverted from the klystron.

High-power circulators, which include cooled ferrite structures exposed to static magnetic fields in microwave junction zones an which were designed specifically for very high power, high-frequency applications, are disclosed by Fumiaki Okada et al in the publications, IEEE Transactions on Microwave Theory and Techniques, Vol. MTT-26, No. 5, May, 1978, pages 364–369, and IEEE Transactions on Magnetics, Vol. MAG-17, No. 6, November, 1981, pages 2957–2960. In the circulators described in these publications, the ferrite structure is composed of a plurality of ferrite discs which are separated from one another by air gaps and which are arranged perpendicularly to the static magnetic field on metal carriers through which a coolant flows.

SUMMARY OF THE INVENTION

It is an object of the present invention to provide a circulator of the above-mentioned type which is suitable, in particular, for operation at very high power at high-frequencies.

This object can be attained, according to the present invention, by providing a ferrite structure that is composed of a plurality of stacked ferrite balls.

By dividing the ferrite into a plurality of balls, a very large cooling surface results, and this makes it possible to dissipate large quantities of heat. Therefore, the circulator can be operated at very high power without the ferrite material being destroyed by thermal stresses.

DESCRIPTION OF THE PREFERRED EMBODIMENTS

Figure 1:
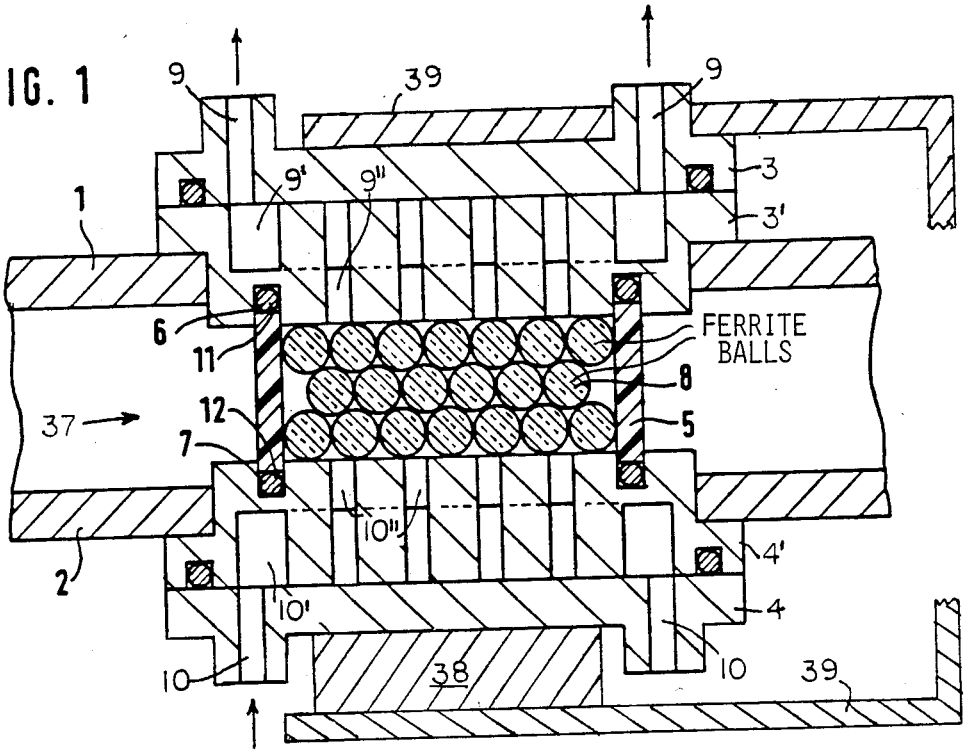
FIG. 1 is a cross-sectional view through the junction zone of a waveguide circulator in accordance with the present invention.
Figure 3:
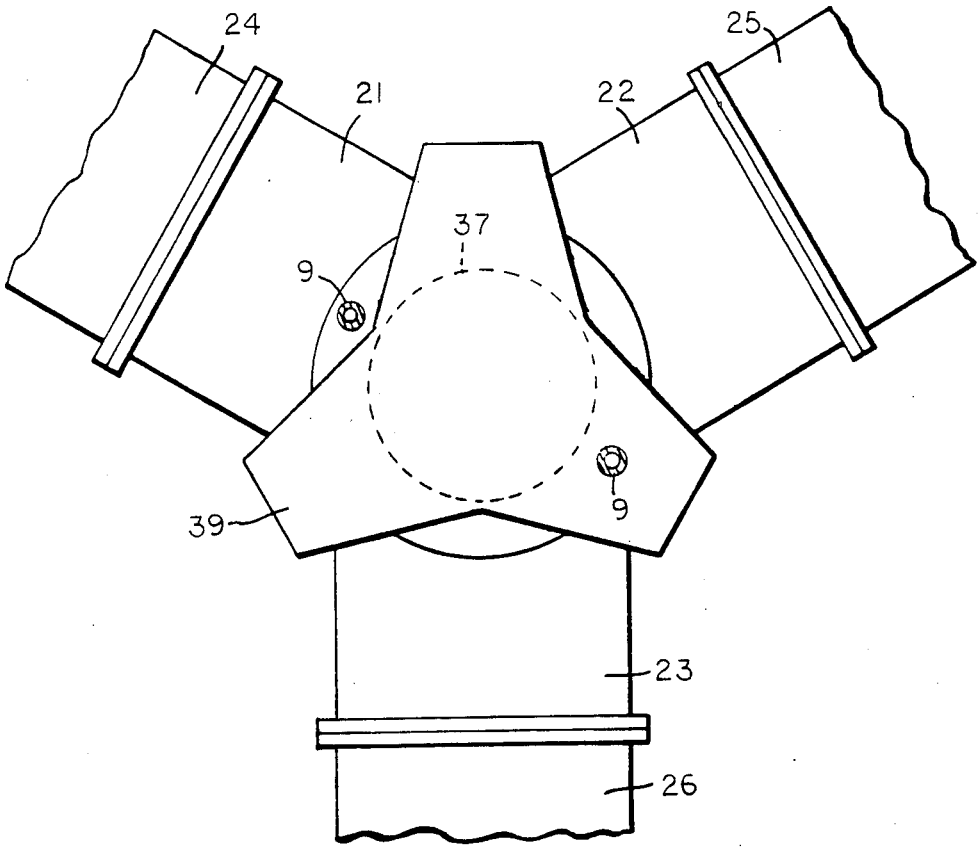
FIG. 3 is a top plan view of the waveguide circulator of FIG. 1.

With initial reference to FIG. 3, waveguide circulator 20 has three ports 21, 22, and 23 which are connected to microwave transmission lines such as hollow waveguides 24, 25, and 26. Ports 21–23 communicate with a microwave junction zone within circulator 20, and resonator structure 37 is disposed in the microwave junction zone. FIG. 1 illustrates the junction zone of waveguide circulator 20 in cross section, along with two opposing waveguide walls 1 and 2 and a magnet system. The magnet system includes top pole piece elements 3 and 3', bottom pole piece elements 4 and 4', a permanent magnet 38 adjacent bottom pole piece element 4, and a yoke 39 forming a magnetic return outside the junction zone. One side of yoke 39 rests on top pole piece element 3, and the other side rests on bottom pole piece element 4. Pole piece elements 3' and 4' are mounted in openings in waveguide walls 1 and 2 respectively so as to project into the interior of the junction zone.

Between the two pole pieces elements 3' and 4', there is included in the waveguide junction a dielectric cylinder 5 which is inserted into grooves 6 and 7 in facing surfaces of the pole piece elements. This dielectric cylinder 5 serves to accommodate a plurality of stacked ferrite lumps such as ferrite balls 8 which form a dense pack, so that a cylindrical ferrite ball heap is created which contacts both pole piece element 3' and pole piece element 4'.

As a whole, ferrite balls 8 form a very large surface area, thus providing extremely favorable conditions for the dissipation of the heat existing in ferrite balls 8. With the aid of a coolant flowing around the ferrite balls, e.g. gas or a suitable dielectric liquid, very large quantities of heat can easily be removed from the heap of ferrite balls 8. For this purpose, inlet channels 10 are provided in pole piece element 4 to receive a gaseous or liquid coolant. The coolant passes through lateral channel 10' in element 4' to holes 10" in element 4', and then to the balls 8. Confined by cylinder 5, the coolant then flows through holes 9" in element 3' to lateral channel 9', and then to outlet channels 9 in element 3. In order to keep coolant from escaping from dielectric cylinder 5 into the waveguide arms of circulator 20, dielectric cylinder 5 is sealed by sealing rings 11 and 12 disposed in grooves 6 and 7 of pole piece elements 3' and 4'. Holes 9" and 10" in elements 3' and 4' have such dimensions that they are impermeable to the high-frequency field in circulator 20.

The direct contact of elements 3' and 4' with the ferrite balls 8 creates a rather small magnetic resistance for the static magnetic field generated between pole piece elements 3' and 4'. Consequently, the magnetic field required to magnetize the heap of ferrite balls 8 can be generated by a relatively inexpensive magnet system.

Figure 2:
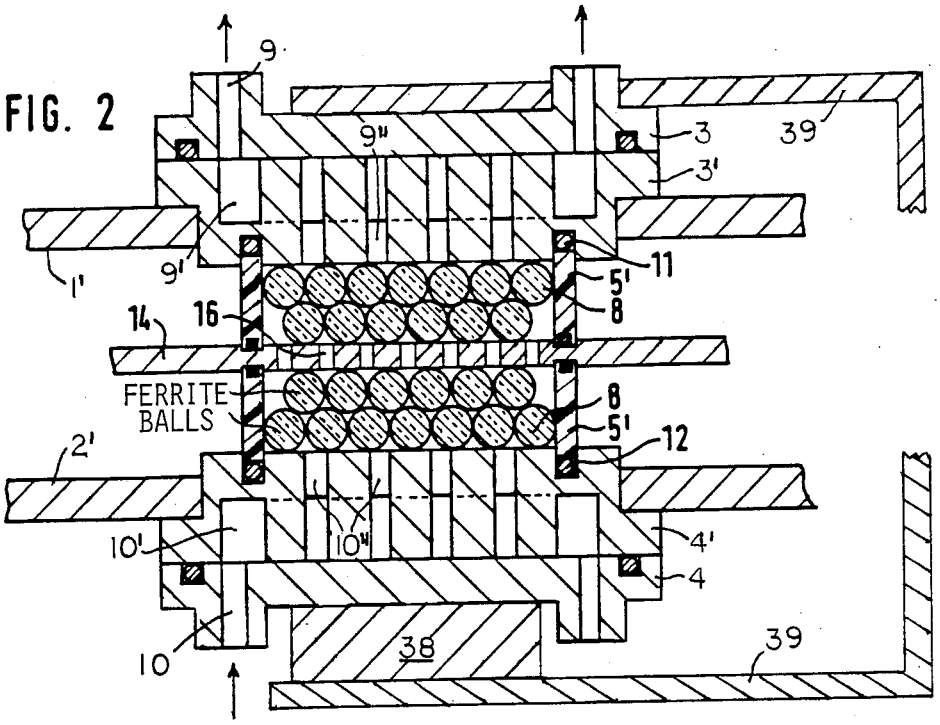
FIG. 2 is a cross-sectional view through the junction zone of a stripline circulator in accordance with the present invention.

FIG. 2 is a cross-sectional view of a portion of a junction circulator which employs stripline technology.

Inner conductor 14, together with pole piece elements 3' and 4', which serve as outer conductors, form a microwave junction configured in stripline technology. Elements 3'0 and 4' are electrically connected to conductive strips 1' and 2', respectively. In this stripline junction circulator, all parts correpponding to waveguide circulator 20 bear the same reference numerals employed in FIG. 1. In contrast to waveguide circulator 20, this embodiment is provided with two dielectric cylinders 5' filled with ferrite balls 8. One dielectric cylinder 5', with its ferrite balls 8, is disposed between the upper side of inner conductor 14 and element 3', while the other dielectric cylinder 5' with its ferrite balls 8 is disposed between the underside of inner conductor 14 and element 4'. In order for the coolant to be able to flow from one dielectric cylinder 5' to the other cylinder 5', the inner conductor 14 is provided with holes 16. Dielectric cylinders 5' are sealed against the escape of coolant at pole piece elements 3' and 4' and at inner conductor 14. Inner conductor 14 may also be made of a magnetically conductive material so as to minimize the magnetic resistance of the arrangement between the pole piece elements 3' and 4'.

The distance between the waveguide walls 1 and 2 of the embodiment shown in FIG. 1 which operates for example at a frequency of 4 GHz is 29 mm, and the spacing between the pole piece elements 3' and 4' of this embodiment is 15–20 mm.

The territe balls 8 positioned in the junction zone have a diameter of 1 mm.

The present disclosure relates to the subject matter disclosed in Federal Republic of Germany application, Ser. No. P 36 33 910.5, filed Oct. 4th, 1986, the entire disclosure of which is incorporated herein by reference.

It will be understood that the above description of the present invention is susceptible to various modifications, changes, and adaptations, and the same are intended to be comprehended within the meaning and range of equivalents of the appended claims.

What we claim is:

1. A junction circulator having a plurality of ports for connection to microwave transmission lines, comprising:

junction means, defining a microwave junction zone, for communicating microwaves between the ports and the microwave junction zone;

means for generating a static magnetic field which penetrates the microwave junction zone; and a ferrite structure disposed in the microwave junction zone, the ferrite structure including a plurality of ferrite lumps which are stacked so that the ferrite lumps are in contact with one another, with a plurality of fluid passages extending through the stack of ferrite lumps.

2. The junction circulator of claim 1, wherein the means for generating a static magnetic field comprises a pair of pole piece elements, and further comprising hollow dielectric sleeve means, disposed in the microwave junction zone, for containing the ferrite lumps in a densely packed arrangement between the pole piece elements, each of the pole piece elements being in contact with ferrite lumps.

3. The junction circulator of claim 2, wherein the dielectric sleeve means comprises a hollow dielectric cylinder.

4. The junction circulator of claim 2, wherein the pole piece elements have holes which communicate with the interior of the dielectric sleeve means, and further comprising means for circulating a coolant through the interior of the dielectric sleeve means via the holes.

5. The junction circulator of claim 1, further comprising means for circulating a coolant through the stacked ferrite lumps.

6. The junction circulator of claim 1, wherein the transmission lines are hollow waveguides, wherein the junction means comprises a pair of spaced apart waveguide walls having inner surfaces and having openings, and wherein the means for generating a static magentic field comprises a pair of pole piece elements, each pole piece element being disposed in an opening of a respective waveguide wall and projecting beyond the inner surface of the respective waveguide wall so that the pole piece elements confine the stacked ferrite lumps.

7. The junction circulator of claim 6, wherein the pole piece elements have holes, and further comprising hollow dielectric sleeve means for containing the ferrite lumps in a densely packed arrangement between the pole piece elements, the interior of the dielectric sleeve means communicating with the holes in the pole piece elements, and means for circulating a coolant through the interior of the dielectric sleeve means via the holes.

8. The junction circulator of claim 1, wherein the transmission lines are striplines, wherein the jucction means comprises a pair of spaced apart outer conductors having openings and an inner conductor having holes, the inner conductor being disposed between and spaced apart from the outer conductors, whereintthe means for generating a static magnetic field comprises a pair of pole piece elements having holes, each pole piece element being disposed in an opening of a respective outer conductor, wherein the ferrite lumps are disposed on both sides of the inner conductor between the inner conductor and respective pole piece element, and further comprising hollow dielectric sleeve means for containing the ferrite lumps between the center conductor and the pole piece elements, the holes of the pole piece elements and the inner conductor communicating with the interior of the dielectric sleeve means, and means for circulating a coolant through the interior of the dielectric sleeve means via the holes in the pole piece elements and the inner conductor.

9. The junction circulator of claim 8, wherein the dielectric sleeve means comprises a pair of hollow dielectric cylinders, each cylinder being disposed on a respective side of the inner conductor.

10. A junction circulator having a plurality of ports for connection to microwave transmission lines, comprising:

junction means, defining a microwave junction zone, for communicating microwaves between the ports and the microwave junction zone;

means for generating a static magnetic field which penetrates the microwave junction zone; and a ferrite structure disposed in the microwave junction zone, the ferrite structure including a plurality of stacked ferrite balls.

11. The junction circulator of claim 11, wherein the ferrite balls are substantially spherical and have substantially equal radii.

* * * * *